US009903162B2

(12) United States Patent
Siracki et al.

(10) Patent No.: US 9,903,162 B2
(45) Date of Patent: Feb. 27, 2018

(54) SPACING OF ROLLING CUTTERS ON A FIXED CUTTER BIT

(71) Applicant: Smith International, Inc., Houston, TX (US)

(72) Inventors: Michael A. Siracki, The Woodlands, TX (US); Michael G. Azar, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 778 days.

(21) Appl. No.: 14/369,469

(22) PCT Filed: Dec. 19, 2012

(86) PCT No.: PCT/US2012/070512

§ 371 (c)(1),
(2) Date: Jun. 27, 2014

(87) PCT Pub. No.: WO2013/101578

PCT Pub. Date: Jul. 4, 2013

(65) Prior Publication Data

US 2014/0360789 A1 Dec. 11, 2014

Related U.S. Application Data

(60) Provisional application No. 61/581,277, filed on Dec. 29, 2011.

(51) Int. Cl.
*E21B 10/43* (2006.01)
*E21B 10/573* (2006.01)
(Continued)

(52) U.S. Cl.
CPC ..... *E21B 10/43* (2013.01); *E21B 10/573* (2013.01); *E21B 10/14* (2013.01); *E21B 2010/425* (2013.01)

(58) Field of Classification Search
CPC .. E21B 10/43; E21B 10/573; E21B 2010/425; E21B 10/14
See application file for complete search history.

(56) References Cited

U.S. PATENT DOCUMENTS 4,104,344 A 8/1978 Pope et al.
4,288,248 A 9/1981 Bovenkerk et al.
(Continued)

FOREIGN PATENT DOCUMENTS

CN 101427000 A 5/2009
WO 2013074898 A1 5/2013
WO 2013085869 A1 6/2013

OTHER PUBLICATIONS

Dictionary definition of "rotatable", accessed Mar. 6, 2017 via thefreedictionary.com.*

(Continued)

*Primary Examiner* — Blake E Michener

(57) ABSTRACT

A downhole cutting tool may include a cutting element support, structure having a plurality of cutter pockets formed therein; and a plurality of rotatable cutters disposed in the plurality of cutter pockets, wherein at least one rotatable cutter is spaced from another rotatable cutter on the cutting element support structure by at least one-quarter of the diameter of the at least one rotatable cutter.

15 Claims, 8 Drawing Sheets

(51) Int. Cl.
*E21B 10/14* (2006.01)
*E21B 10/42* (2006.01)

(56) References Cited

U.S. PATENT DOCUMENTS

| | | | | |
|---|---|---|---|---|
| 4,499,958 | A * | 2/1985 | Radtke | E21B 10/55 175/413 |
| 4,907,662 | A * | 3/1990 | Deane | E21B 10/43 175/431 |
| 5,127,923 | A | 7/1992 | Bunting et al. | |
| 5,265,685 | A * | 11/1993 | Keith | E21B 10/04 175/431 |
| 5,531,281 | A * | 7/1996 | Murdock | E21B 10/43 175/431 |
| 5,549,171 | A * | 8/1996 | Mensa-Wilmot | E21B 10/43 175/431 |
| 5,551,522 | A | 9/1996 | Keith et al. | |
| 5,816,346 | A * | 10/1998 | Beaton | E21B 10/43 175/431 |
| 7,703,559 | B2 | 4/2010 | Shen et al. | |
| 2001/0030063 | A1* | 10/2001 | Dykstra | E21B 10/42 175/57 |
| 2001/0030065 | A1* | 10/2001 | Beuershausen | E21B 10/43 175/327 |
| 2003/0029642 | A1* | 2/2003 | Dykstra | E21B 10/42 175/57 |
| 2007/0199739 | A1 | 8/2007 | Schwefe et al. | |
| 2007/0240905 | A1* | 10/2007 | Mensa-Wilmot | E21B 10/567 175/57 |
| 2007/0267227 | A1* | 11/2007 | Mensa-Wilmot | E21B 10/43 175/426 |
| 2008/0179107 | A1* | 7/2008 | Doster | E21B 10/55 175/431 |
| 2010/0108403 | A1 | 5/2010 | Keshavan | |
| 2010/0263937 | A1 | 10/2010 | Overstreet et al. | |
| 2011/0198128 | A1 | 8/2011 | McClain et al. | |
| 2011/0284293 | A1 | 11/2011 | Shen et al. | |
| 2011/0297454 | A1 | 12/2011 | Shen et al. | |
| 2012/0132471 | A1 | 5/2012 | Zhang et al. | |
| 2012/0205163 | A1 | 8/2012 | Azar et al. | |
| 2012/0234610 | A1 | 9/2012 | Azar et al. | |
| 2012/0273280 | A1 | 11/2012 | Zhang et al. | |
| 2012/0273281 | A1 | 11/2012 | Burhan et al. | |
| 2013/0140094 | A1 | 6/2013 | Burhan et al. | |
| 2013/0146367 | A1 | 6/2013 | Zhang et al. | |

OTHER PUBLICATIONS

International Search Report and Written Opinion issued in PCT/US2012/070512 dated Apr. 25, 2013, 34 pages.
Office Action issued in CN201280070810.3 dated Jun. 19, 2015; 13 pages with translation.

* cited by examiner

SPACING OF ROLLING CUTTERS ON A FIXED CUTTER BIT

BACKGROUND

Technical Field

Embodiments disclosed herein relate generally to the placement and spacing of rotatable cutting elements on a downhole cutting tool.

Background Art

Various types and shapes of earth boring bits are used in various applications in the earth drilling industry. Earth boring bits have bit bodies which include various features such as a core, blades, and cutter pockets that extend into the bit body or roller cones mounted on a bit body, for example. Depending on the application/formation to be drilled, the appropriate type of drill bit may be selected based on the cutting action type for the bit and its appropriateness for use in the particular formation.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical application, a compact of polycrystalline diamond (PCD) (or other ultrahard material) is bonded to a substrate material, which is typically a sintered metal-carbide to form a cutting structure. PCD comprises a polycrystalline mass of diamonds (typically synthetic) that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A PDC cutter is conventionally formed by placing a sintered carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn integrally bonded to the substrate. The substrate often comprises a metal-carbide composite material, such as tungsten carbide-cobalt. The deposited diamond layer is often referred to as the "diamond table" or "abrasive layer."

An example of a prior art PDC bit having a plurality of cutters with ultra hard working surfaces is shown in FIGS. 1A and 1B. The drill bit 200 includes a bit body 210 having a threaded upper pin end 211 and a cutting end 215. The cutting end 214 typically includes a plurality of ribs or blades 220 arranged about the rotational axis L (also referred to as the longitudinal or central axis) of the drill bit and extending radially outward from the bit body 210. Cutting elements, or cutters, 250 are embedded in the blades 220 at predetermined angular orientations and radial locations relative to a working surface and with a desired back rake angle and side rake angle against a formation to be drilled.

A plurality of orifices 216 are positioned on the bit body 210 in the areas between the blades 220, which may be referred to as "gaps" or "fluid courses." The orifices 216 are commonly adapted to accept nozzles. The orifices 216 allow drilling fluid to be discharged through the bit in selected directions and at selected rates of flow between the blades 220 for lubricating and cooling the drill bit 200, the blades 220 and the cutters 250. The drilling fluid also cleans and removes the cuttings as the drill bit 200 rotates and penetrates the geological formation. Without proper flow characteristics, insufficient cooling of the cutters 250 may result in cutter failure during drilling operations. The fluid courses are positioned to provide additional flow channels for drilling fluid and to provide a passage for formation cuttings to travel past the drill bit 200 toward the surface of a wellbore (not shown).

Referring to FIG. 1B, a top view of a prior art PDC bit is shown. The cutting face 218 of the bit shown includes six blades 220. Each blade includes a plurality of cutting elements or cutters generally disposed radially from the center of cutting face 218 to generally form rows. Certain cutters, although at differing axial positions, may occupy radial positions that are in similar radial position to other cutters on other blades.

Cutters are conventionally attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation. Specifically, alloys suitable for brazing cutting elements with diamond layers thereon have been limited to only a couple of alloys which offer low enough brazing temperatures to avoid damage to the diamond layer and high enough braze strength to retain cutting elements on drill bits.

A significant factor in determining the longevity of PDC cutters is the exposure of the cutter to heat. Conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. As a cutting element contacts the formation, a wear flat develops and frictional heat is induced. As the cutting element is continued to be used, the wear flat will increase in size and further induce frictional heat. The heat may build-up that may cause failure of the cutting element due to thermal mis-match between diamond and catalyst discussed above. This is particularly true for cutters that are immovably attached to the drill bit, as conventional in the art.

Accordingly, there exists a continuing need to develop ways to extend the life of a cutting element.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole cutting tool that includes a cutting element support structure having a plurality of cutter pockets formed therein; and a plurality of rotatable cutters disposed in the plurality of cutter pockets, wherein at least one rotatable cutter is spaced from another rotatable cutter on the cutting element support structure by at least one-quarter of the diameter of the at least one rotatable cutter.

In another aspect, embodiments disclosed herein relate to a downhole cutting tool that includes a tool body; a plurality of cutting element support structures having a plurality of cutter pockets formed therein; and a plurality of rotatable cutters disposed in the plurality of cutter pockets, wherein the plurality of rotatable cutters are placed on the downhole cutting tool such that the cutting faces of adjacent cutters on a rotated cutting profile of the plurality of rotatable cutters are at least tangent to one another.

In yet another aspect, embodiments disclosed herein relate to a downhole cutting tool that includes a tool body; a plurality of cutting element support structures having a plurality of cutter pockets formed therein; and a plurality of rotatable cutters disposed in the plurality of cutter pockets, wherein the plurality of rotatable cutters are placed on the downhole cutting tool such that the cutting faces of adjacent cutters on a rotated cutting profile of the plurality of rotatable cutters do not overlap Other aspects and advantages of the claimed subject matter will be apparent from the following description and the appended claims.

DETAILED DESCRIPTION

In one aspect, embodiments disclosed herein relate to spacing of rotatable cutting elements on a downhole cutting tool, such as a fixed cutter drill bit. Generally, rotatable cutting elements (also referred to as rolling cutters) described herein allow at least one surface or portion of the cutting element to rotate as the cutting elements contact a formation. As the cutting element contacts the formation, the cutting action may allow portion of the cutting element to rotate around a cutting element axis extending through the cutting element. Rotation of a portion of the cutting structure may allow for a cutting surface to cut the formation using the entire outer edge of the cutting surface, rather than the same section of the outer edge, as observed in a conventional cutting element. In contrast, as a drill bit having conventional, fixed cutters contacts and cuts an earthen formation, the cutting surface and cutting edge of a fixed cutter may wear and form a wear flat, after which the drill bit may be tripped as having reached the end of the cutting element life. Because the cutting edge of a rotatable cutter is continuously rotating, each rotatable cutter may not develop or may take longer to develop a wear flat, and thus may achieve a longer life, as compared to a conventional, fixed cutting element. Thus, the present inventors have determined that the number of rotatable cutting elements may be reduced by providing increased spacing between adjacent cutting elements on a blade because of such reduced wear of the cutting edge. Advantageously, increasing the spacing between cutters and/or reducing the number of cutters may provide for increased rate of penetration due to the load being distributed to fewer cutters while drilling.

Figure 1A:
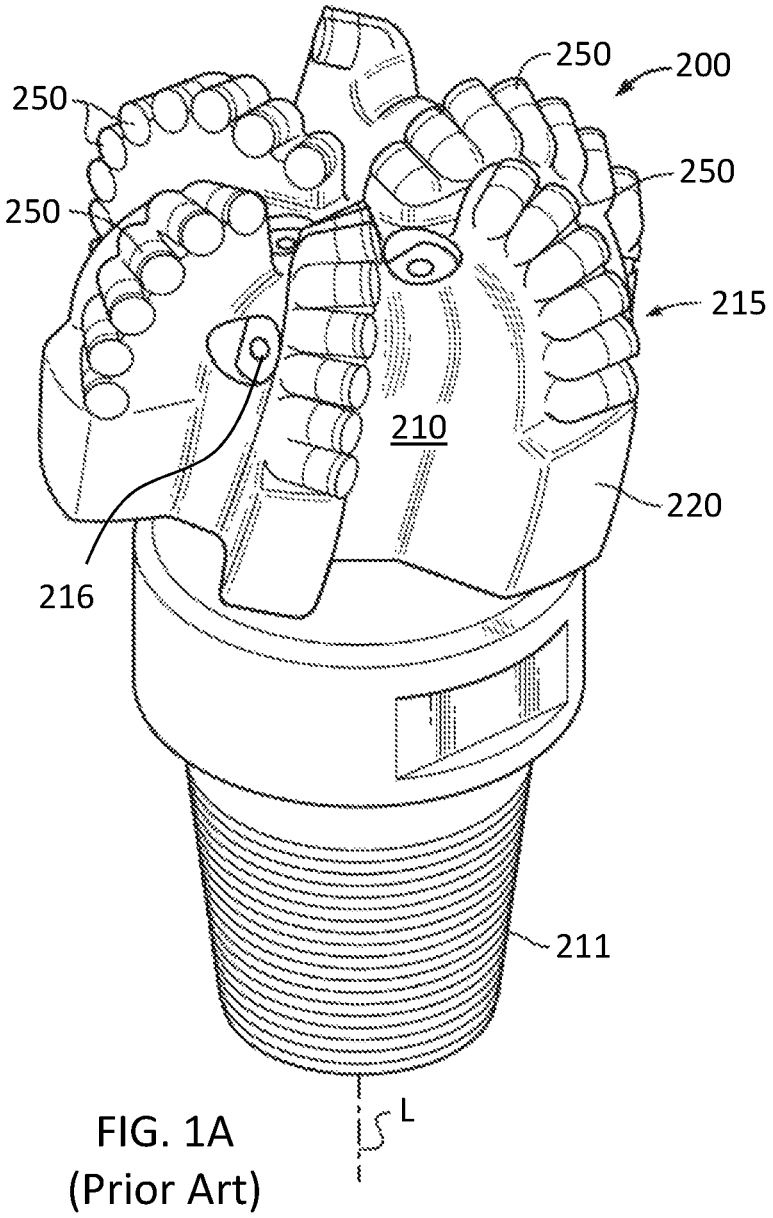
FIG. 1A (Prior Art)
FIGS. 1A and 1B show a side and top view of a conventional drag bit.
Figure 1B:
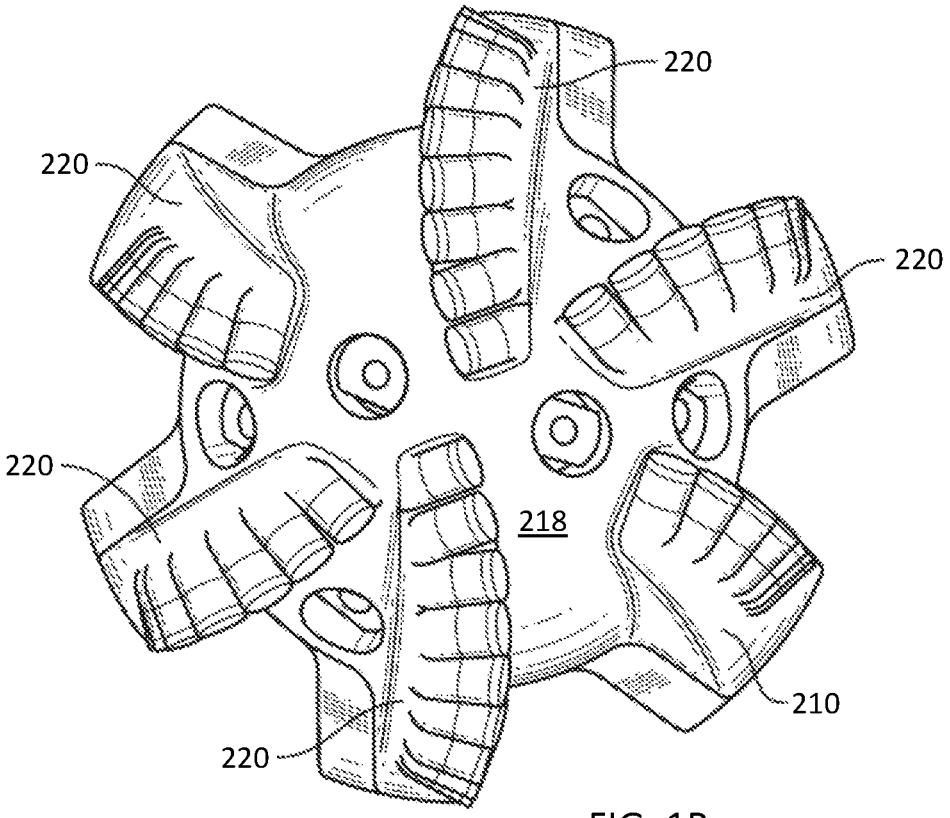
FIG. 1B (Prior Art)
Figure 2:
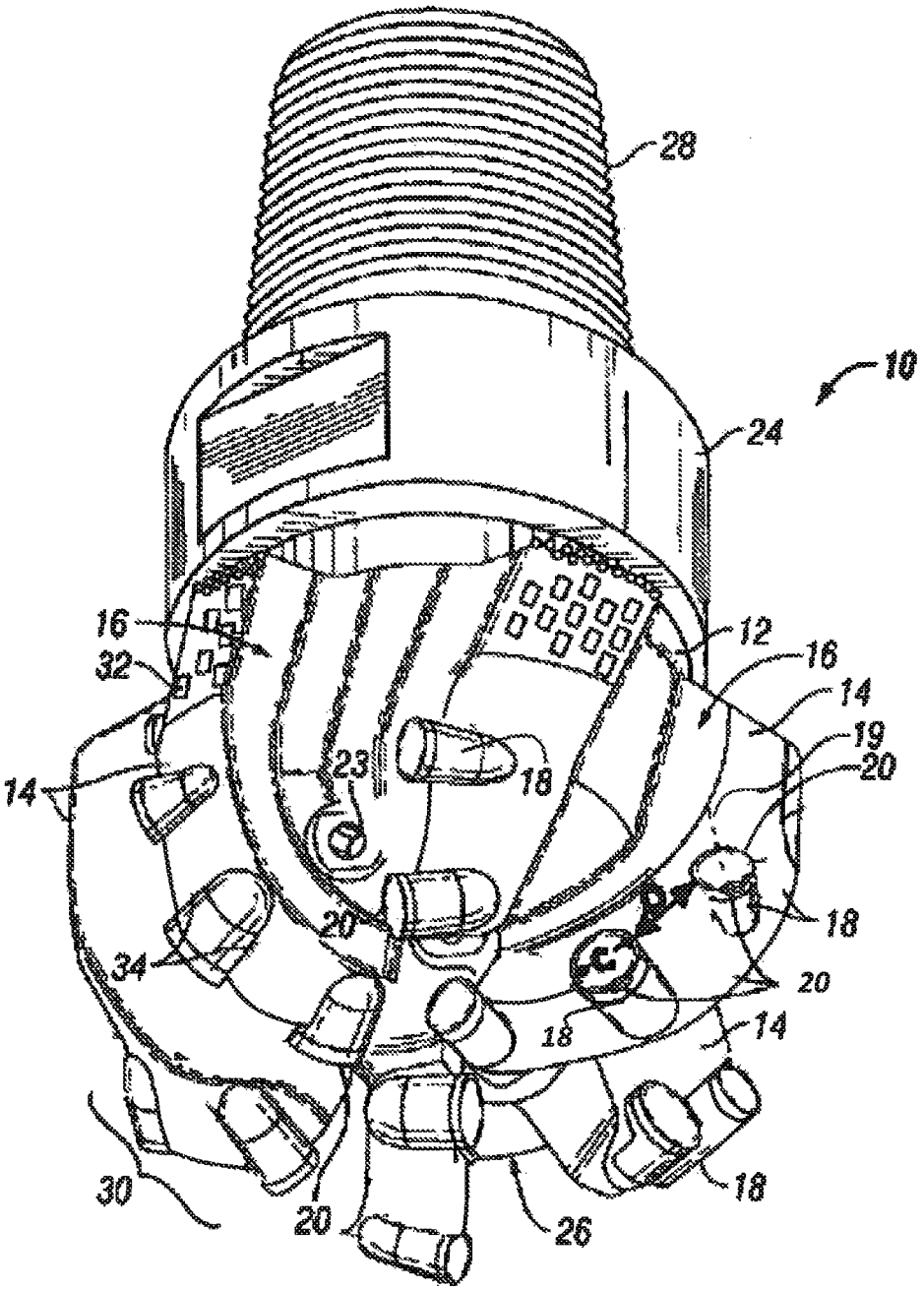
FIG. 2 shows an embodiment of a fixed cutter drill bit having rotatable cutters disposed thereon.

Referring now to FIG. 2, FIG. 2 shows a fixed cutter drill bit on which a plurality of rotatable cutting elements are disposed. As shown in FIG. 2, a drill bit 10 includes a bit body 12 and a plurality of blades 14 that are radially extending from the bit body 12. The blades 14 are separated by channels or gaps 16 that enable drilling fluid to flow between and both clean and cool the blades 14 and rolling cutters 18. Rolling cutters 18 are held in the blades 14 in such a manner to allow the rolling cutters to rotate about their own axis 19 to such that the entire edge 20 (which interacts against a formation to be drilled) of rolling cutters 18 may be exposed to the formation upon cutter rotation.

Nozzles 23 are typically formed in the drill bit body 12 and positioned in the gaps 16 so that fluid can be pumped to discharge drilling fluid in selected directions and at selected rates of flow between the cutting blades 14 for lubricating and cooling the drill bit 10, the blades 14, and the cutters 18. The drilling fluid also cleans and removes the cuttings as the drill bit rotates and penetrates the geological formation. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. Crown 26 includes a plurality of holes or pockets 34 that are sized and shaped to receive a corresponding plurality of cutters 18 (or cutter assemblies including an inner rotatable cutting element and a sleeve) having a cutter diameter of length C.

The combined plurality of cutting edges 20 of the cutters 18 effectively forms the cutting face of the drill bit 10. Once the crown 26 is formed, the cutters 18 are positioned in the pockets 34 and affixed by any suitable method such that the cutters 18 are free to rotate about their axes 19.

As shown in FIG. 2, two adjacent rolling cutters may be spaced a distance D apart from one another. In one embodiment, D may be equal to or greater than one-quarter the value of cutter diameter C, i.e., $\frac{1}{4}C \leq D$. In other embodiments, the lower limit of D may be any of 0.25C, 0.33C, 0.5C, 0.67C, 0.75C, C, or 1.5C, and the upper limit of D may be any of 0.5C, 0.67C, 0.75C, C, 1.25C, 1.5C, 1.75C, or 2C, where any lower limit may be in combination with any upper limit.

Figure 3:
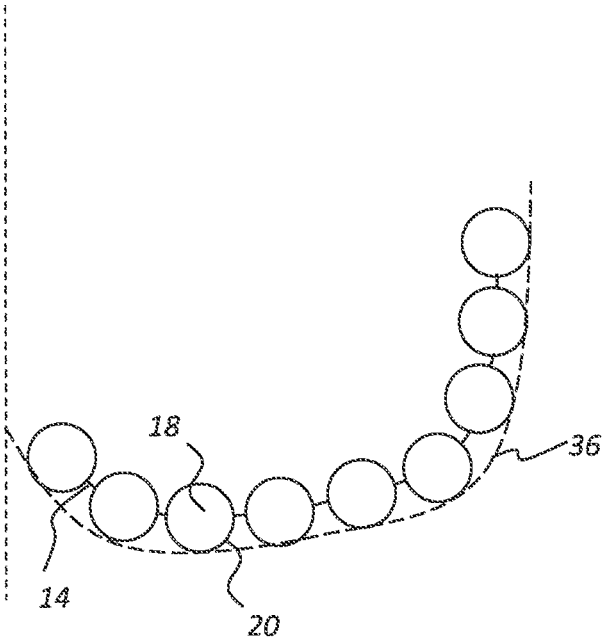
FIG. 3 shows an embodiment of a cutting profile of cutting elements rotated into a single plane view.

The selection of the particular spacing between adjacent cutters 18 may be based on the number of blades, for example, and/or the desired extent of overlap between radially adjacent cutters when all cutters are rotated into a rotated profile view. For example, in some embodiments, it may be desirable to have full bottom hole coverage (no gaps in the cutting profile formed from the rolling cutters) between all of the cutters 18 on the bit 10, whereas in other embodiments, it may be desirable to have a portion uncovered by the cutting profile, as illustrated in FIG. 3, which shows an embodiment of a cutting profile 36 of cutters 18 when rotated into a single plane view extending outward from a longitudinal axis L of bit (not shown). In such an embodiment, as illustrated in FIG. 3, when all of the cutters 18 (from all blades) are rotated into a single plane view, there is no overlap in the cutting edges 20 of cutters 18 so that as the bit (not shown) rotates, a portion of formation will encounter blade 14 at the radial positions between cutters 18. In some embodiments, the width between radially adjacent cutters 18 (when rotated into a single plane) may range from 0.1 inches up to the diameter of the cutter (i.e. C). In other embodiments, the lower limit of the width between cutters 18 (when rotated into a single plane) may be any of 0.2C, 0.4C, 0.5C, 0.6C, or 0.8C, and the upper limit of the width between cutters 18 (when rotated into a single plane) may be any of 0.4C, 0.5C, 0.6C, 0.8C, or C, where any lower limit may be in combination with any upper limit.

Figure 4:
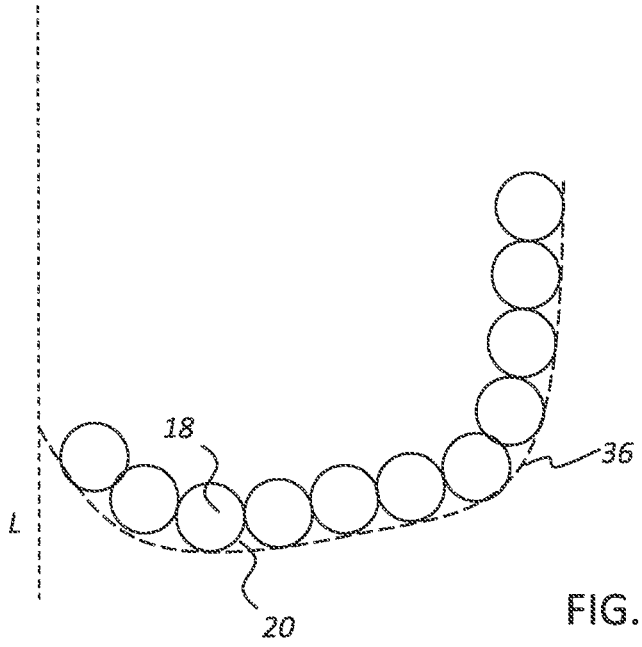
FIG. 4 shows an embodiment of a cutting profile of cutting elements rotated into a single plane view.
Figure 5:
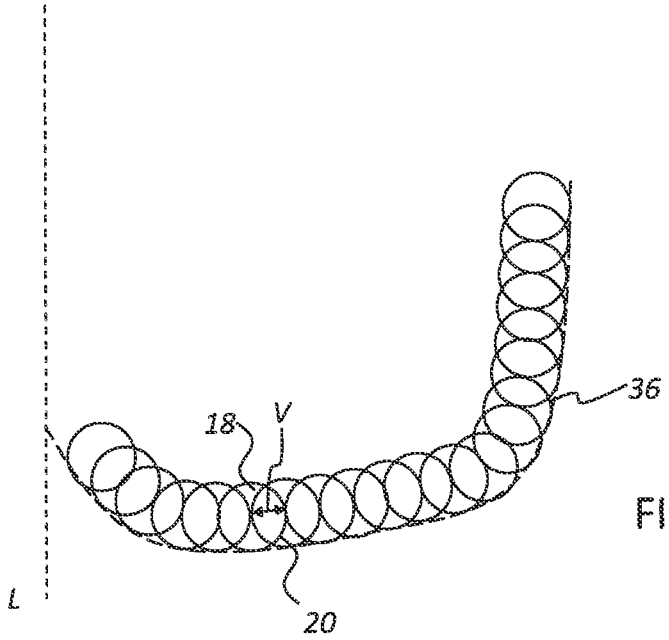
FIG. 5 shows an embodiment of a cutting profile of cutting elements rotated into a single plane view.

However, as mentioned above, when full bottom-hole coverage is desirable, the cutting edges 20 of radially adjacent (in a rotated view) cutters 18 may be at least tangent to one another, as illustrated in FIG. 4 which shows another embodiment of cutting profile 36 of cutters 18 when rotated into a single plane view extending outward from a longitudinal axis L of bit (not shown). As illustrated in FIG. 5, showing another embodiment of cutting profile 36 of cutters 18 when rotated into a single plane view extending outward from a longitudinal axis L of bit (not shown), the cutting edges 20 of radially adjacent (in a rotated view) cutters 18 may overlap by an extent V. Overlap V may be defined as the distance along the cutting face of cutters 18 of overlap that is substantially parallel to the corresponding portion of the cutting profile 36. In one embodiment, the upper limit of overlap V between two radially adjacent (in a rotated view) cutters 18 may be equal to the radius of the cutter (or one-half the cutter diameter C), i.e., $V \leq C/2$. In other embodiments, the upper limit of overlap V may be based on radius (C/2) and the number of blades 14 present on the bit, specifically the radius divided the number of blades, i.e., C/2B, where B is the number of blades. Thus, for a two-bladed bit, the upper limit of overlap V may be C/4, and for a four-bladed bit, the upper limit of overlap V may be C/8. Thus, V may generally range from $0 < V \leq C/2$, and in specific embodiments, the lower limit of V may be any of C/10B, C/8B, C/6B, C/4B, C/2B, or 0.1C, 0.2C, 0.3C, or 0.4C (for any number of blades), and the upper limit of V may be any of, C/8B, C/6B, C/4B, C/2B, 0.2C, 0.3C, 0.4C, or 0.5C, where any lower limit may be used with any upper limit.

Further the above embodiments all reference rotating cutting elements or cutters 18. It is specifically intended that any one of the rotatable cutting elements 18 may be replaced with a conventional or fixed cutting element. For example, in specific embodiments, it might be desirable to include a fixed cutting element at the radially most interior position(s) on the blade(s), i.e., in the cone region of the bit and/or along the gage portion of the bit. Further, in such an instance, the spacing described with respect to the above embodiments may apply only to the rotatable cutting elements or it may also apply to the fixed cutting elements. In embodiments using a combination of rotatable cutting elements and fixed cutting elements, it may be particularly desirable to have rotatable cutting elements present along at least a nose or shoulder portion of the cutting profile.

While the above described embodiments refer to cutting elements having distinct radial positions on a cutting profile with respect to a bit axis L, i.e., a single set configuration, according to other embodiments of the present disclosure, rolling cutter placement design criteria may be set so that rolling cutters on a drill bit have a plural set configuration. Drill bits having a plural set configuration have more than one cutting element at at least one radial position with respect to the bit axis. Expressed alternatively, at least one cutting element includes a "back up" cutting element disposed at about the same radial position with respect to the bit axis. In an embodiment, a bit having a plural set configuration may have both the primary or leading cutting element and the back-up or trailing cutting element be rotatable cutting elements. In another embodiment, a bit having a plural set configuration may have at least one fixed cutter trailing cutting element and at least one rotatable cutter leading cutting element. In another embodiment, a bit having a plural set cutter configuration may have at least one trailing or backup cutting element that is rotatable and at least one leading or primary cutting element that is a fixed cutter.

In an example embodiment, cutting faces of primary cutting elements may have a greater extension height than the cutting faces of backup cutting elements (i.e., "onprofile" primary cutting elements engage a greater depth of the formation than the backup cutting elements; and the backup cutting elements are "off-profile"). As used herein, the term "off-profile" may be used to refer to a structure extending from the cutter-supporting surface (e.g., the cutting element, depth-of-cut limiter, etc.) that has an extension height less than the extension height of one or more other cutting elements that define the outermost cutting profile of a given blade. As used herein, the term "extension height" is used to describe the distance a cutting face extends from the cutter-supporting surface of the blade to which it is attached. In some embodiments, a back-up cutting element may be at the same exposure as the primary cutting element, but in other embodiments, the primary cutter may have a greater exposure or extension height above the backup cutter. Such extension heights may range, for example, from 0.005 inches up to C/2 (the radius of a cutter). In other embodiments, the lower limit of the extension height may be any of 0.1C, 0.2C, 0.3C, or 0.4C and the upper limit of the extension height may be any of 0.2C, 0.3C, 0.4C, or 0.5C, where any lower limit may be used with any upper limit.

Further, instead or in addition to back-up cutting elements, it may also be desirable to place TSP segments and/or conical cutting elements on a blade rearward of primary cutting elements cutting elements to protect the blade surface and/or to aid in gouging of the formation. Such conical cutting elements are described in detail in U.S. Patent Application Nos. 61/441,319 and 61/499,851, both of which are assigned to the present assignee and herein incorporated by reference in their entirety. Conical cutting elements may be placed on a blade in any of the configurations described in U.S. Patent Application Nos. 61/441,319 and 61/499,851, or in particular embodiments, may be located at a radial intermediate position between two cutters (on the same blade or on two or more different blades in a leading or trailing position with respect to the cutters) or at the same radial position as one or more cutters in a trailing position.

Figure 6:
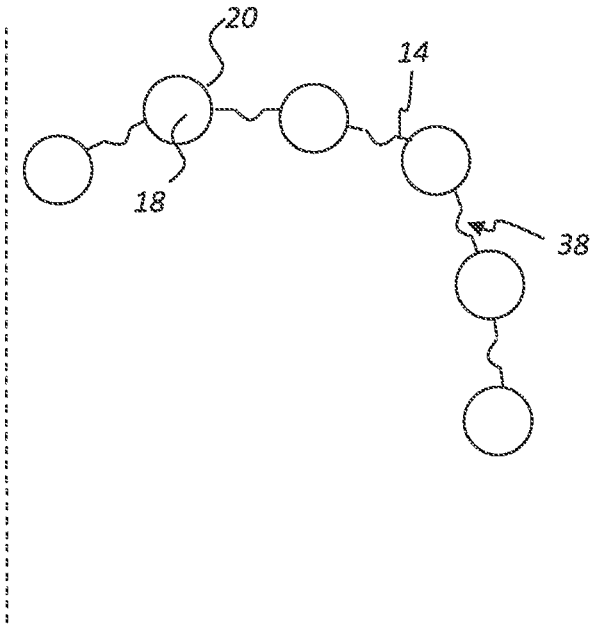
FIG. 6 shows an embodiment of a blade having cutting elements thereon.
Figure 7:
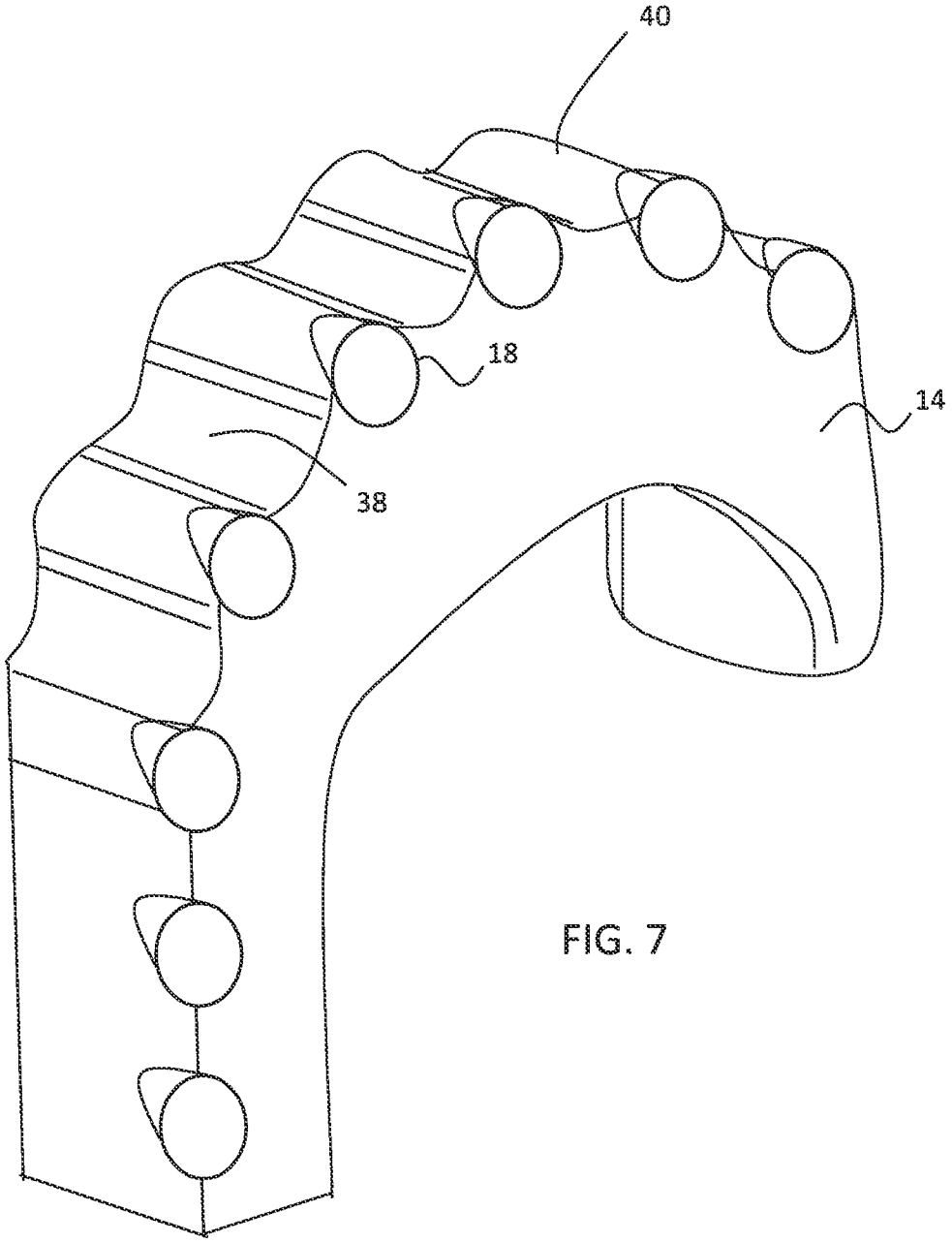
FIG. 7 shows an embodiment of a blade having cutting elements thereon.

Further, given the spacing between adjacent cutting elements (on the same blade), it may be desirable to create a channel or recessed region in the blade top between adjacent (on the same blade) cutting elements. For example, referring to FIG. 6, an embodiment of a blade having a plurality of rotating cutting elements is shown. As shown in FIG. 6, a blade 14 may have a plurality of rotatable cutting elements 18 disposed thereon (with any of the above described spacing). Blade 14 may, at radially intermediate positions between adjacent cutting elements 18, have a channel 38 formed therein. Channel may extend any width or depth, including from the leading edge to the trailing edge of blade 14, or any depth therebetween. Channel 38 may extend the entire radial width between adjacent cutting elements 18 such that the entire blade top 40 possesses an undulating surface, as illustrated in FIG. 7.

Positioning of rolling cutters on a drill bit may include adjusting the back rake (i.e., vertical orientation) and the side rake (i.e., a lateral orientation) of the cutting element, or adjusting the extension height of the cutting element. Discussion of such placement considerations that may be used for the rolling cutters of the present disclosure include those aspects disclosed in U.S. Patent Publication No. 2011/0284293 and U.S. patent application Ser. No. 13/303,837, which are assigned to the present assignee and herein incorporated by reference in their entirety. In another embodiment, a cutter may have a back rake ranging from about 5 to 35 degrees. In a particular embodiment, the back rake angle of a rolling cutter may be >5 degrees, >10 degrees, >15 degrees, >20 degrees, >25 degrees, >30 degrees, and/or <10 degrees, <15 degrees, <20 degrees, <25, <30 degrees, <35 degrees, with any upper limit being used with any lower limit.

In one embodiment, a cutter may have a side rake ranging from 0 to Â45 degrees, for example 5 to ±35 degrees, 10 to ±35 degrees or 15 to ±30 degrees. In a particular embodiment, the direction (positive or negative) of the side rake may be selected based on the cutter distribution, i.e., whether the cutters are arranged in a forward or reverse spiral configuration. In more particular embodiments, the side rake angle may be >5 degrees, >10 degrees, >15 degrees, >20 degrees, >25 degrees, >30 degrees, and/or <10 degrees, <15 degrees, <20 degrees, <25 degrees, <30 degrees, <35 degrees, with any of such angles being positive or negative, and any upper limit being used with any lower limit. One of ordinary skill in the art may realize that any back rake and side rake combination may be used with the cutting elements of the present disclosure to enhance rotatability and/or improve drilling efficiency.

Figure 8:
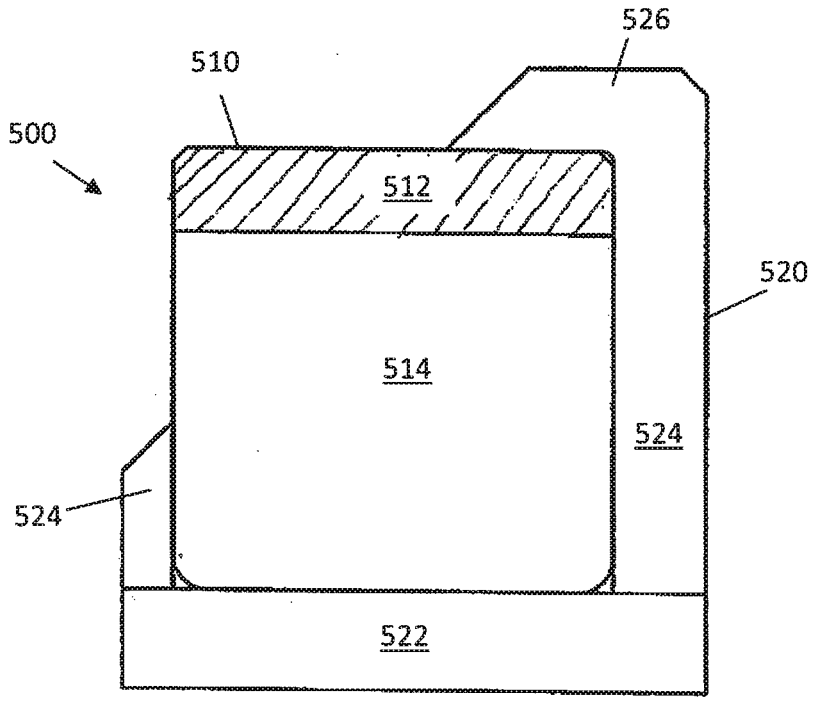
FIG. 8 shows an example of a rotatable cutting element.

The above discussion describes various embodiments for a rotatable cutting element; however, the present disclosure is not so limited. One skilled in the art would appreciate that any cutting element capable of rotating may be used with the drill bit or other cutting tool of the present disclosure. Rolling cutters of the present disclosure may include various types and sizes of rolling cutters. For example, rolling cutters may be formed in sizes including, but not limited to, 9 mm, 13 mm, 16 mm, and 19 mm. Further, rolling cutters may include those held within an outer support element, held by a retention mechanism or blocker, or a combination of the two. Examples of rolling cutters that may be used in the present disclosure may be found at least in U.S. Pat. No. 7,703,559, U.S. Patent Publication No. 2011/0297454, and U.S. Patent Application Nos. 61/351,035, 61/479,151, 61/479,183, 61/566,875, 61/566,859, 61/561,016, 61/559,423, which are assigned to the present assignee and hereby incorporated by reference in their entirety. Exemplary embodiments of rolling cutters are also described below; however, the types of rotatable cutting elements that may be used with the present disclosure are not necessarily limited to any type of rotatable cutting element. One example of a rotatable cutting element disposed in a sleeve is shown in FIG. 8. As shown in this embodiment, cutting element 500 includes an inner rotatable cutting element 510 which is partially disposed in and thus, partially surrounded by an outer support element or sleeve 520. Outer support element 520 includes a bottom portion 522, a side portion 524, and a top portion 526. Inner rotatable cutting element 510 includes a cutting face 512 portion disposed on an upper surface of substrate 514. Inner rotatable cutting element is disposed within the cavity defined by the bottom portion 522, side portion 524, and top portion 526. Due to the structural nature of this embodiment, inner rotatable cutting element is mechanically retained in the outer support element 520 cavity by bottom portion 522, side portion 524, and top portion 526. As shown in FIG. 3, top portion 526 extends partially over the upper surface of cutting face 512 so as to retain inner rotatable cutting element 510 and also allow for cutting of a formation by the inner rotatable cutting element 510.

Each of the embodiments described herein have at least one ultrahard material included therein. Such ultra hard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by removing substantially all metal from the interstitial spaces between interconnected diamond particles or from a diamond/silicon carbide composite, or other ultra hard material such as a cubic boron nitride. Further, in particular embodiments, the inner rotatable cutting element may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is optionally disposed may be formed of a variety of hard or ultra hard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultra hard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be preferable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

The outer support element, such as a sleeve) may be formed from a variety of materials. In one embodiment, the outer support element may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. In a particular embodiment, the outer support element is a cemented tungsten carbide with a cobalt content ranging from 6 to 13 percent.

It is also within the scope of the present disclosure that the outer support element (sleeve or blade) and/or retention component (or any component interfacing the cutting element, particularly when the cutting element is rotatable) may also include more lubricious materials to reduce the coefficient of friction. The components may be formed of such materials in their entirely or have portions of the components including such lubricious materials deposited on the component, such as by chemical plating, chemical vapor deposition (CVD) including hollow cathode plasma enhanced CVD, physical vapor deposition, vacuum deposition, arc processes, or high velocity sprays). In a particular embodiment, a diamond-like coating may be deposited through CVD or hallow cathode plasma enhanced CVD, such as the type of coatings disclosed in US 2010/0108403, which is assigned to the present assignee and herein incorporated by reference in its entirety.

Any of the above described embodiments may also include the use of diamond or carbide between interfacing surfaces of the rotatable cutting element and cutter pocket and/or retention component in which it is retained, such as shown in FIG. 8. For example, diamond (or a similar material) may be incorporated on either the inner rotatable cutting element or the outer support element on any radial or axial bearing surface, or a separate diamond component may be used placed between the two components. For example, the bottom face of an inner rotatable cutting element or the shoulder of a sleeve may be formed of diamond or a similar material. Use of diamond on various bearing surfaces (integral with the cutting element components) is described in U.S. Pat. No. 7,703,559, which is assigned to the present assignee and herein incorporated by reference in its entirety. Alternatively (and/or additionally), a separate diamond disc or washer may be placed adjacent a bottom face of the inner rotatable cutting element or adjacent the shoulder of a sleeve on which an inner rotatable cutting element rests.

The cutting elements of the present disclosure may be incorporated in various types of downhole cutting tools, including for example, as cutters in fixed cutter bits or as inserts in roller cone bits, reamers, hole benders, or any other tool that may be used to drill earthen formations. Cutting tools having the cutting elements of the present disclosure may include a single rotatable cutting element with the remaining cutting elements being conventional cutting elements, all cutting elements being rotatable, or any combination therebetween of rotatable and conventional cutting elements.

In some embodiments, the placement of the cutting elements on the blade of a fixed cutter bit may be selected such that the rotatable cutting elements are placed in areas experiencing the greatest wear. For example, in a particular embodiment, rotatable cutting elements may be placed on the shoulder or nose area of a fixed cutter bit.

The cutting elements of the present disclosure may be attached to or mounted on a drill bit by a variety of mechanisms, including but not limited to conventional attachment or brazing techniques of a sleeve or other support element (retaining the rotatable cutting element) in a cutter pocket, including by any of the mechanisms described in U.S. Pat. No. 7,703,559, U.S. Patent Publication No. 2011/0297454, and U.S. Patent Application Nos. 61/351,035, 61/479,151, 61/479,183, 61/566,875, 61/566,859, 61/561,016, and 61/559,423. It is also within the scope of the present disclosure that in some embodiments, an inner rotatable cutting element may be mounted on the bit directly such that the bit body acts as the outer support element, i.e., by inserting the inner rotatable cutting element into a hole that may be subsequently blocked to retain the inner rotatable cutting element within.

Embodiments of the present disclosure may provide at least one of the following advantages. Increasing the spacing between cutters and/or reducing the number of cutters may provide for increased rate of penetration due to the load being distributed to fewer cutters while drilling. Further, by increasing the spacing between adjacent cutters, more durable cutter pockets and/or greater flexibility in rolling cutter sleeve designs may be achieved.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A downhole cutting tool, comprising:

at least one blade having a plurality of cutting pockets formed therein;

a plurality of rotatable cutters disposed in the plurality of cutter pockets and rotatable within the plurality of cutter pockets, wherein at least one rotatable cutter of the plurality of rotatable cutters is spaced from another rotatable cutter of the plurality of rotatable cutters on the at least one blade by at least one-quarter of the diameter of the at least one rotatable cutter, the at least one rotatable cutter and the another rotatable cutter being adjacent cutting elements on a same blade of the at least one blade; and wherein the plurality of rotatable cutters are placed on the downhole cutting tool such that the cutting faces of adjacent cutters on a rotated cutting profile of the plurality of cutters are tangent to one another.

2. The downhole tool of claim 1, wherein the at least one rotatable cutter is spaced from the another rotatable cutter on the same one of the at least one blade by at least one-half of the diameter of the at least one rotatable cutter.

3. The downhole tool of claim 1, wherein the at least one rotatable cutter is spaced from the another rotatable cutter on the same one of the at least one blade by up to two times the diameter of the at least one rotatable cutter.

4. The downhole tool of claim 1, wherein the at least one rotatable cutter is spaced from the another rotatable cutter on the same one of the at least one blade by up to one times the diameter of the at least one rotatable cutter.

5. The downhole cutting tool of claim 1, wherein at least one cutter pocket of the plurality of cutter pockets has a sleeve disposed therein between the at least one cutter pocket and the at least one rotatable cutter.

6. The downhole cutting tool of claim 1, wherein at least one of the plurality of rotatable cutters in a leading position is at a higher exposure than another one of the plurality of rotatable cutters at a trailing position.

7. The downhole cutting tool of claim 1, further comprising:

at least one cutter fixedly attached in at least one cutter pocket of the plurality of cutter pockets.

8. The downhole cutting tool of claim 1, wherein the downhole tool comprises a fixed cutter drill bit and wherein the at least one blade comprises a plurality of blades extending radially from a bit body.

9. A downhole cutting tool, comprising:

a tool body;

a plurality of cutting element support structures having a plurality of cutter pockets formed therein; and a plurality of rotatable cutters disposed in the plurality of cutter pockets and which are rotatable therein, wherein the plurality of rotatable cutters are placed on the downhole cutting tool such that the cutting faces of adjacent cutters on a rotated cutting profile of the plurality of rotatable cutters are tangent to one another.

10. The downhole cutting tool of claim 9, wherein at least one cutter pocket of the plurality of cutter pockets has a sleeve disposed therein between the at least one cutter pocket and the at least one rotatable cutter.

11. The downhole cutting tool of claim 9, wherein at least one of the plurality of rotatable cutters in a leading position is at a higher exposure than another one of the plurality of rotatable cutters at a trailing position.

12. The downhole cutting tool of claim 9, further comprising:

at least one cutter fixedly attached and non-rotatable within in at least one cutter pocket of the plurality of cutter pockets.

13. The downhole cutting tool of claim 9, wherein the downhole tool comprises a fixed cutter drill bit and wherein the cutting element support structure comprises a plurality of blades extending radially from a bit body.

14. A downhole cutting tool, comprising:

a tool body;

a plurality of cutting element support structures having a plurality of cutter pockets formed therein; and a plurality of rotatable cutters disposed in the plurality of cutter pockets and which are rotatable therein, wherein the plurality of rotatable cutters are placed on the downhole cutting tool such that the cutting faces of adjacent cutters on a rotated cutting profile of the plurality of rotatable cutters do not overlap.

15. The downhole cutting tool of claim 14, wherein the cutting faces of each pair of adjacent cutters in the rotated cutting profile do not overlap.

* * * * *